US010058989B2

(12) United States Patent
Chellew

(10) Patent No.: US 10,058,989 B2
(45) Date of Patent: Aug. 28, 2018

(54) DISPLAY ASSEMBLIES HAVING INTEGRATED DISPLAY COVERS AND LIGHT PIPES AND HANDHELD POWER TOOLS AND METHODS INCLUDING SAME

(75) Inventor: Justin Terrance Chellew, Bridgewater, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 828 days.

(21) Appl. No.: 14/004,104

(22) PCT Filed: Mar. 31, 2011

(86) PCT No.: PCT/US2011/030640

§ 371 (c)(1),
(2), (4) Date: Sep. 9, 2013

(87) PCT Pub. No.: WO2012/134469

PCT Pub. Date: Oct. 4, 2012

(65) Prior Publication Data

US 2014/0008088 A1 Jan. 9, 2014

(51) Int. Cl.
*B25F 5/02* (2006.01)
*B25F 5/00* (2006.01)
(Continued)

(52) U.S. Cl.
CPC ..... *B25F 5/00* (2013.01); *B25F 5/021* (2013.01); *F21V 5/04* (2013.01); *F21V 17/00* (2013.01); *Y10T 29/49002* (2015.01)

(58) Field of Classification Search
CPC .. F21V 17/00; F21V 15/01; B25F 5/00; B25F 5/02
(Continued)

(56) References Cited

U.S. PATENT DOCUMENTS 5,539,194 A * 7/1996 Miller ..... B60R 11/02 235/454
5,555,550 A * 9/1996 Kaschke ..... H04M 1/0202 341/22
(Continued)

FOREIGN PATENT DOCUMENTS

CN 2860754 Y 1/2007
CN 201544172 U 8/2010
(Continued)

OTHER PUBLICATIONS

European Search Report dated Feb. 15, 2011 from European Patent Application No. 11862292.7 filed Mar. 31, 2011.
(Continued)

*Primary Examiner* — Gloria R Weeks
(74) *Attorney, Agent, or Firm* — Jones IP Group; Wayne A. Jones

(57) ABSTRACT

A handheld power tool includes a housing, a display device mounted on the housing, at least one light source mounted in the housing, and an integral, light transmissive lens member. The lens member includes a cover portion covering the display device to protect the display device from the environment, and a light pipe portion positioned and configured to transmit light emitted from the at least one light source to a location on the handheld power tool visible exteriorly of the housing.

20 Claims, 10 Drawing Sheets

(51) Int. Cl.
*F21V 5/04* (2006.01)
*F21V 17/00* (2006.01)

(58) Field of Classification Search
USPC ..... 173/20; 362/119, 23.07, 23.1, 97.1, 612; 345/905, 82
See application file for complete search history.

(56) References Cited

U.S. PATENT DOCUMENTS 5,563,482 A * 10/1996 Shaw ..... B25B 23/147 173/176
6,023,414 A * 2/2000 Fujii ..... G09F 9/302 257/88
6,474,378 B1 * 11/2002 Ryan ..... B27C 5/02 144/136.95
6,687,567 B2 * 2/2004 Watanabe ..... B25B 23/1405 173/11
6,692,432 B1 * 2/2004 Yarush ..... A61B 1/00039 600/109
6,713,956 B2 * 3/2004 Hsing Chen ..... F21V 29/004 313/46
6,834,977 B2 * 12/2004 Suehiro ..... G02B 6/0068 362/119
6,950,680 B2 * 9/2005 Kela ..... H04M 1/0202 345/901
7,029,142 B2 * 4/2006 Chen ..... B25B 21/00 173/4
7,157,882 B2 * 1/2007 Johnson ..... B25F 5/02 320/134
7,249,861 B2 * 7/2007 Coleman ..... G06F 1/1662 200/314
7,353,084 B2 * 4/2008 Schaper ..... H02J 3/00 361/52
7,369,916 B2 * 5/2008 Etter ..... B23B 39/00 173/2
7,497,649 B2 * 3/2009 Zhong ..... B27C 5/10 144/136.95
7,534,162 B2 * 5/2009 Bottema ..... B24B 37/16 451/288
8,235,552 B1 * 8/2012 Tsuge ..... F21L 4/04 362/253
8,328,381 B2 * 12/2012 Dixon ..... B25F 5/021 362/109
8,381,830 B2 * 2/2013 Puzio ..... B23B 31/1074 173/132
8,820,955 B2 * 9/2014 Dixon ..... B25B 21/00 362/119
8,919,456 B2 * 12/2014 Ng ..... G05B 15/02 173/11
9,242,355 B2 * 1/2016 Sergyeyenko ..... B25B 21/00
9,281,770 B2 * 3/2016 Wood ..... H02P 7/06
9,347,760 B2 * 5/2016 Thorley ..... G01B 5/0028
2002/0044136 A1 * 4/2002 Griffin ..... G06F 1/1626 345/169
2004/0021630 A1 * 2/2004 Lai ..... G02F 1/133308 345/102
2005/0121209 A1 * 6/2005 Shimizu ..... B25F 5/02 173/217
2005/0174499 A1 * 8/2005 Clark ..... G02B 6/0088 349/16
2006/0002151 A1 * 1/2006 Park ..... G02F 1/133603 362/631
2006/0109258 A1 * 5/2006 Takisawa ..... G06F 3/044 345/173
2006/0155582 A1 * 7/2006 Brown ..... A61B 5/0002 705/3
2006/0162178 A1 * 7/2006 Freidin ..... G01B 3/18 33/784
2006/0163596 A1 * 7/2006 Kim ..... G02F 1/133603 257/98
2007/0012121 A1 1/2007 Hsieh
2007/0035679 A1 * 2/2007 Lee ..... G02F 1/133603 349/58
2008/0009677 A1 * 1/2008 Shoroji ..... A61B 1/00052 600/160
2008/0074865 A1 3/2008 Lutz
2008/0271904 A1 11/2008 Lin
2009/0225159 A1 * 9/2009 Schneider ..... A61B 1/00124 348/82
2009/0229842 A1 * 9/2009 Gray ..... H01M 2/1055 173/20
2010/0038103 A1 2/2010 Ueda et al.
2010/0157587 A1 * 6/2010 Isoda ..... G02B 6/0021 362/231
2010/0188840 A1 * 7/2010 Cho ..... H01R 12/73 362/97.1
2010/0290246 A1 * 11/2010 Kim ..... G02B 6/002 362/602
2012/0234569 A1 * 9/2012 Lawton ..... B25B 21/00 173/181
2013/0278846 A1 * 10/2013 Holman ..... G02B 26/0841 349/14
2013/0327552 A1 * 12/2013 Lovelass ..... B25F 5/00 173/1
2014/0166323 A1 * 6/2014 Cooper ..... B23Q 11/0092 173/1
2015/0041164 A1 * 2/2015 Sergyeyenko ..... B25B 21/008 173/1
2015/0150556 A1 * 6/2015 McCuen ..... A61B 17/07207 227/175.1
2015/0253491 A1 * 9/2015 Laycock ..... G02B 6/0043 362/606
2016/0071467 A1 * 3/2016 Elder ..... G09G 3/3406 205/787

FOREIGN PATENT DOCUMENTS

DE 3916355 A1 12/1989
DE 20200813838 U1 4/2009
DE 102008042426 A1 4/2010
EP 2090399 A1 8/2009
EP 2199024 A1 6/2010
GB 2464915 A1 5/2010
JP 2002301669 A 10/2002

OTHER PUBLICATIONS

Office Action dated Nov. 3, 2014 from Chinese Patent Application No. 201180069656.3 filed Mar. 31, 2011.
International Search Report and Written Opinion issued in corresponding PCT Application No. PCT/US2011/030640, dated Mar. 26, 2012 (3 pages).
Notification Concerning Transmittal of International Preliminary Report on Patentability, Application No. PCT/US2011/030640, dated Oct. 10, 2013; 6 pages.

* cited by examiner

DISPLAY ASSEMBLIES HAVING INTEGRATED DISPLAY COVERS AND LIGHT PIPES AND HANDHELD POWER TOOLS AND METHODS INCLUDING SAME

This application is a 35 U.S.C. § 371 national phase application of International Application Serial No. PCT/US2011/030640, filed Mar. 31, 2011, the disclosure of which is incorporated herein by reference in its entirety.

FIELD OF THE INVENTION

The present invention relates to handheld power tools and, more particularly, to handheld power tools having electronic displays and indicator lights.

BACKGROUND OF THE INVENTION

A handheld power tool may include an electronic display device (e.g., a liquid crystal display (LCD) or an organic light emitting diode (OLED) display) and one or more separate indicator lights (e.g., LEDs) to serve as a human-machine interface. LCD and OLED display devices are often manufactured with a plate of glass used as the main structural element holding the LCD/OLED circuitry. The glass can easily break or crack if subjected to mechanical abuse. Therefore, a clear protective lens is often used as a guard for the LCD/OLED display device. This protective lens is often fixed to the tool's housing, usually supported on top of a ledge or lip, so that the protective lens can resist forces applied to the housing. Capture features and/or adhesive are typically used to prevent the protective lens from falling out of the tool.

Many tools that include LCD/OLED display devices also employ LEDs as part of the human-machine interface. To address packaging challenges in confined spaces of the tool, light pipes are often used to transmit light from LEDs mounted on a circuit board located inside the tool housing. This can be a cost-effective solution for delivering control signal lighting to a human-machine interface, as the LEDs do not require individual mechanical mounting and electrical connections.

SUMMARY OF THE INVENTION

According to embodiments of the present invention, a handheld power tool includes a housing, a display device mounted on the housing, at least one light source mounted in the housing, and an integral, light transmissive lens member. The lens member includes a cover portion covering the display device to protect the display device from the environment, and a light pipe portion positioned and configured to transmit light emitted from the at least one light source to a location on the handheld power tool visible exteriorly of the housing.

According to some embodiments, the lens member is a monolithic member.

According to some embodiments, the lens member includes a lens mounting feature to mechanically couple the lens member to the housing. In some embodiments, the housing includes a housing mounting feature that interlocks with the lens mounting feature to mechanically couple the lens member in the housing.

In some embodiments, the at least one light source includes a light emitting diode (LED).

The display device may include at least one of an organic light emitting diode (OLED) display and a liquid crystal display (LCD) having a display screen. The display screen is viewable through the cover portion.

According to some embodiments, the at least one light source includes a plurality of light sources mounted in the housing, and the lens member includes a plurality of light pipe portions each positioned and configured to transmit light emitted from a respective one of the plurality of light sources to a respective one of a plurality of locations on the handheld power tool visible exteriorly of the housing. In some embodiments, the plurality of light pipe portions collectively define a light pipe array having a first width, the cover portion has a second width, the lens member includes a connector portion extending between and connecting the cover portion and the light pipe array, and the connector portion has a third width that is less than each of the first and second widths.

In some embodiments, the housing defines a display opening having a housing beveled edge portion, and the cover portion has a lens beveled edge portion complementary to and seated against the housing beveled edge portion.

According to embodiments of the present invention, an integral, light transmissive lens member is provided for use in a handheld power tool. The integral lens member includes a cover portion and a light pipe portion. The cover portion is configured to cover a display device of the handheld power tool to protect the display device from the environment. The light pipe portion is configured to transmit light emitted from a light source of the handheld power tool to a location on the handheld power tool visible exteriorly of the handheld power tool.

In some embodiments, the lens member is a monolithic member, and includes: a lens mounting feature to mechanically couple the lens member to a housing of the handheld power tool; and a plurality of light pipe portions each configured to transmit light from a respective one of a plurality of light sources of the handheld power tool to a respective one of a plurality of locations on the handheld power tool visible exteriorly of the handheld power tool.

According to some embodiments, the lens member is provided in combination with a display device and a light source, wherein: the cover portion covers the display device to protect the display device from the environment; and the light pipe portion is positioned adjacent the light source to transmit light emitted from the light source.

According to the embodiments of the present invention, a method for forming a handheld power tool includes: providing a housing; mounting a display device on the housing; mounting at least one light source in the housing; and mounting an integral lens member including a cover portion and a light pipe portion on the housing. The lens member is mounted on the housing such that: the cover portion covers the display device to protect the display device from the environment; and the light pipe portion is positioned to transmit light emitted from the at least one light source to a location on the handheld power tool visible exteriorly of the housing.

The method may include unitarily molding the lens member. In some embodiments, the method includes unitarily injection molding the lens member.

According to some embodiments, the lens member includes a lens mounting feature, the housing includes a housing mounting feature, and mounting the integral lens member on the housing includes interlocking the housing mounting feature with the lens mounting feature to mechanically couple the lens member in the housing.

According to some embodiments, the at least one light source includes a light emitting diode (LED), and the display device includes at least one of an organic light emitting diode (OLED) display and a liquid crystal display (LCD) having a display screen. The display screen is viewable through the cover portion.

In some embodiments, the lens member includes a plurality of light pipe portions, and mounting the integral lens member on the housing includes positioning each of the plurality of light pipe portions to transmit light emitted from a respective one of the plurality of light sources to a respective one of a plurality of locations on the handheld power tool visible exteriorly of the housing. According to some embodiments, the plurality of light pipe portions collectively define a light pipe array having a first width, the cover portion has a second width, the lens member includes a connector portion extending between and connecting the cover portion and the light pipe array, and the connector portion has a third width that is less than each of the first and second widths.

In some embodiments, the housing defines a display opening having a housing beveled edge portion, the cover portion has a lens beveled edge portion complementary to the housing beveled edge portion, and mounting the integral lens member on the housing includes seating the lens beveled edge portion against the housing beveled edge portion.

The foregoing and other objects and aspects of the present invention are explained in detail in the specification set forth below.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF THE EMBODIMENTS OF THE INVENTION

Figure 1:
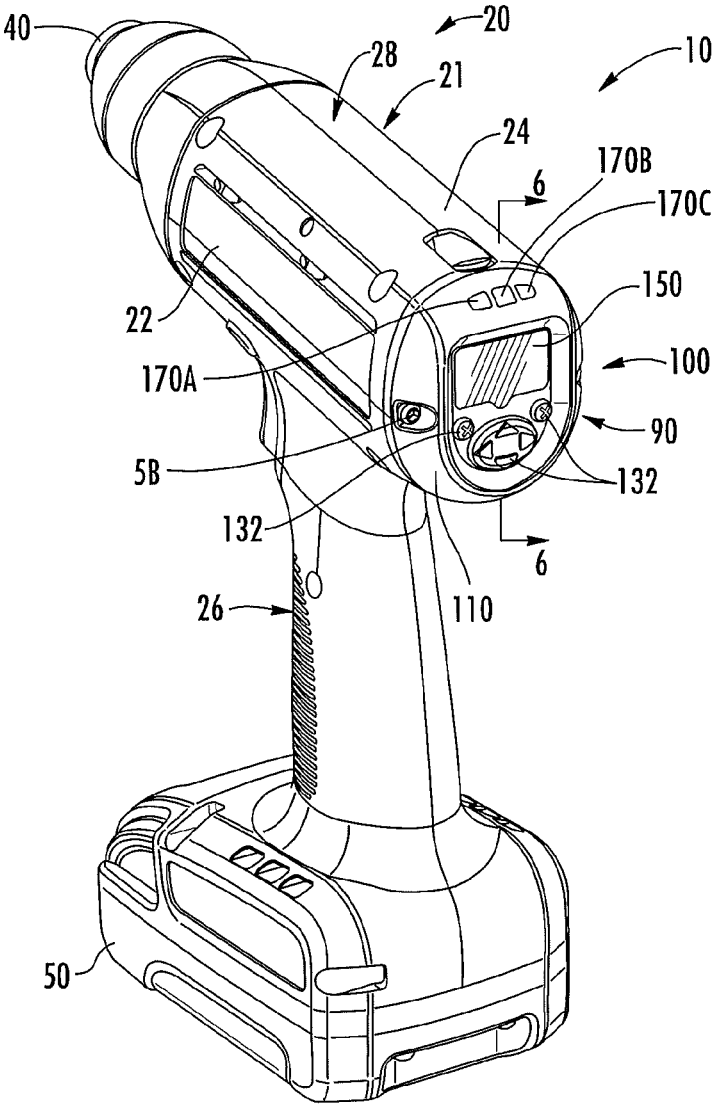
FIG. 1 is a perspective view of a handheld power tool according to embodiments of the present invention from a rear side of the handheld power tool.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

The term "cordless" power tool refers to power tools that do not require plug-in, hard wired electrical connections to an external power source to operate. Rather, the cordless power tools have electric motors that are powered by on-board batteries, such as rechargeable batteries. A range of batteries may fit a range of cordless tools. Different cordless power tools may have a variety of electrical current demand profiles that operate more efficiently with batteries providing a suitable range of voltages and current capacities. The different cordless (e.g., battery powered) power tools can include, for example, drills, screwdrivers, ratchets, nutrunners, impacts and the like.

Embodiments of the invention may be particularly suitable for precision power tool that can be used for applications where more exact control of the applied output is desired.

"Light pipe" refers to a transparent or translucent material that transmits light from one end to another.

As used herein, "monolithic" means an object that is a single, unitary piece formed or composed of a material without joints or seams.

With reference to FIGS. 1-11, a handheld power tool 10 according to embodiments of the present invention is shown therein. The power tool 10 may be any suitable type of handheld power tool and, according to some embodiments, is an electrically powered handheld power tool. According to some embodiments, the power tool 10 is a battery powered cordless power tool.

Figure 2:
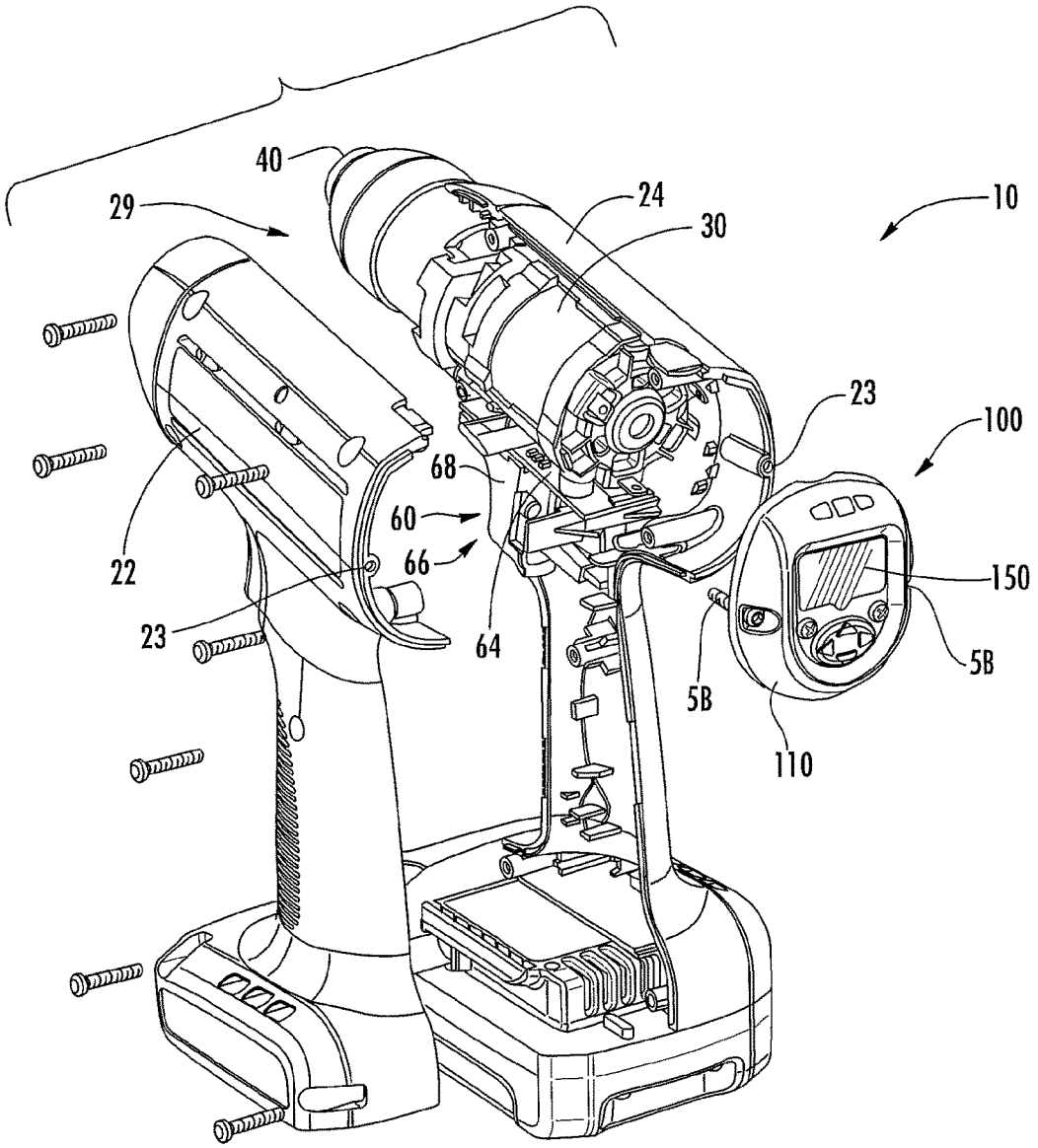
FIG. 2 is an exploded, perspective view of the handheld power tool of FIG. 1 from the rear side of the handheld power tool.

Turning to the power tool 10 in more detail and with reference to FIGS. 1 and 2, the power tool 10 includes a protective housing assembly 20, a drive motor assembly 30, a tool output shaft or drive head 40, a battery pack 50, a control system 60, and a display assembly or module 100. The display module 100 includes a human-machine interface (HMI) 90. The display module 100 further includes an integral, light transmissive lens member 150 according to embodiments of the present invention.

The housing assembly 20 includes a housing 21 having an upper or main body portion 28 and a pistol grip or handle 26 depending therefrom. The housing 21 can be formed by a left shell member 22 and a right shell member 24, which define an enclosed cavity 29 (FIG. 2) therebetween. The housing assembly 20 further includes a rear cover or protective display housing 110, which also forms a part of the display module 100, as discussed hereinbelow.

The drive motor assembly 30 and the battery pack 50 are contained in or attached to the housing 21. The battery pack 50 may be releasably mounted on the lower end of the handle 26. The construction and operation of drive motor assemblies and battery packs in handheld power tools are well known to those of skill in the art and will not be discussed in detail herein. The drive motor assembly 30 may include an electric motor arranged and configured (directly or via a gearcase, linkage or gear assembly) to selectively drive (e.g., rotate) the drive head 40 using power supplied from the battery pack 50.

The control system 60 may be in whole or in part contained in and/or attached to the housing 21. Control systems for handheld power tools are well known to those of skill in the art and therefore will not be described herein in detail. The exemplary control system 60 as illustrated includes a display printed circuit board (PCB) assembly 70 (FIG. 3), a power PCB (not shown), a control PCB 64 (FIG. 2), and a trigger switch 66 including a trigger member 68. The control system 60 may be configured to enable an operator to activate and deactivate the drive motor assembly 30 to drive the drive head 40. The control system 60 may also receive input from the operator and output information to the operator via the HMI 90.

Figure 3:
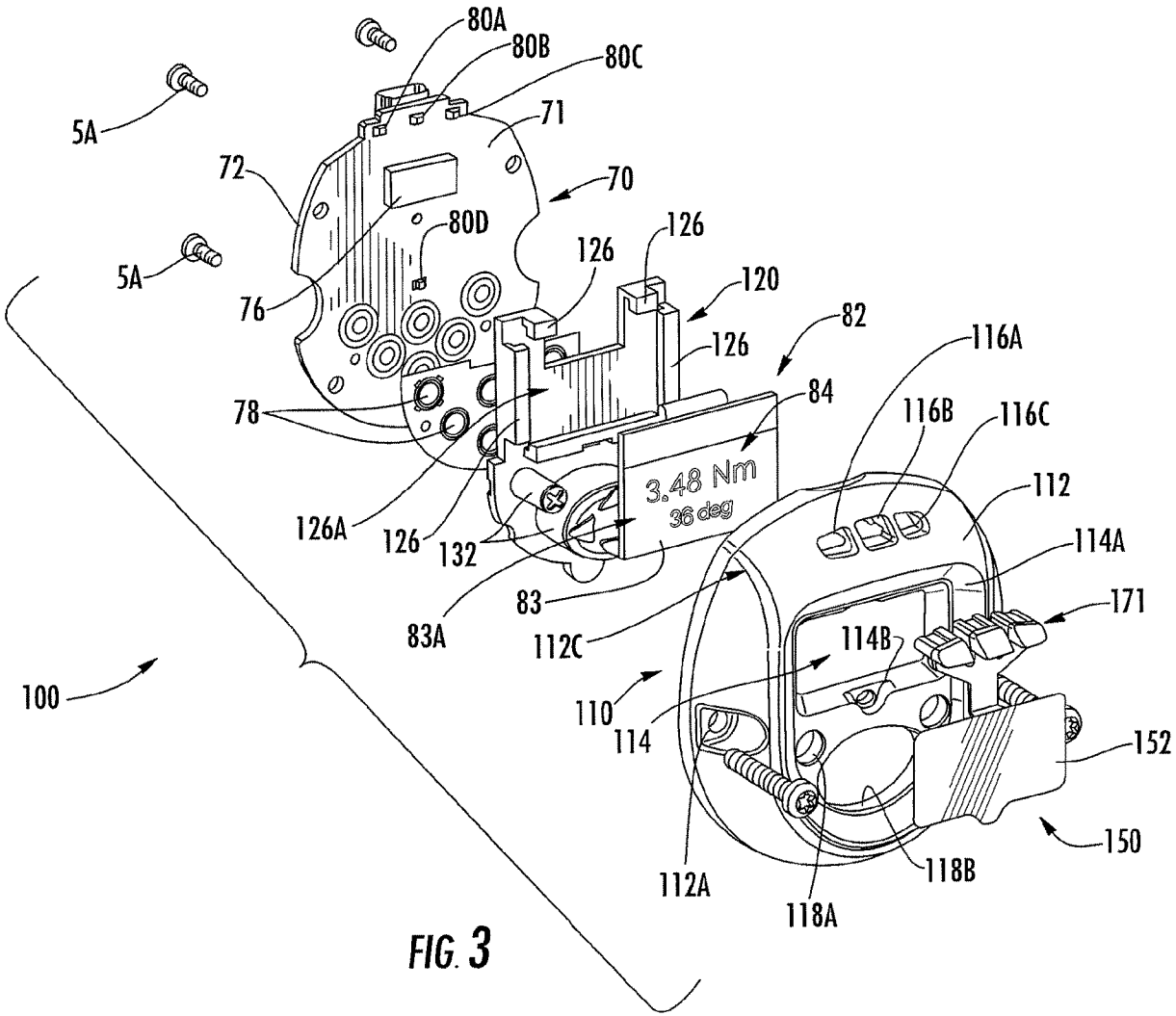
FIG. 3 is an exploded, front perspective view of a display module according to embodiments of the present invention forming a part of the handheld power tool of FIG. 1.
Figure 4:
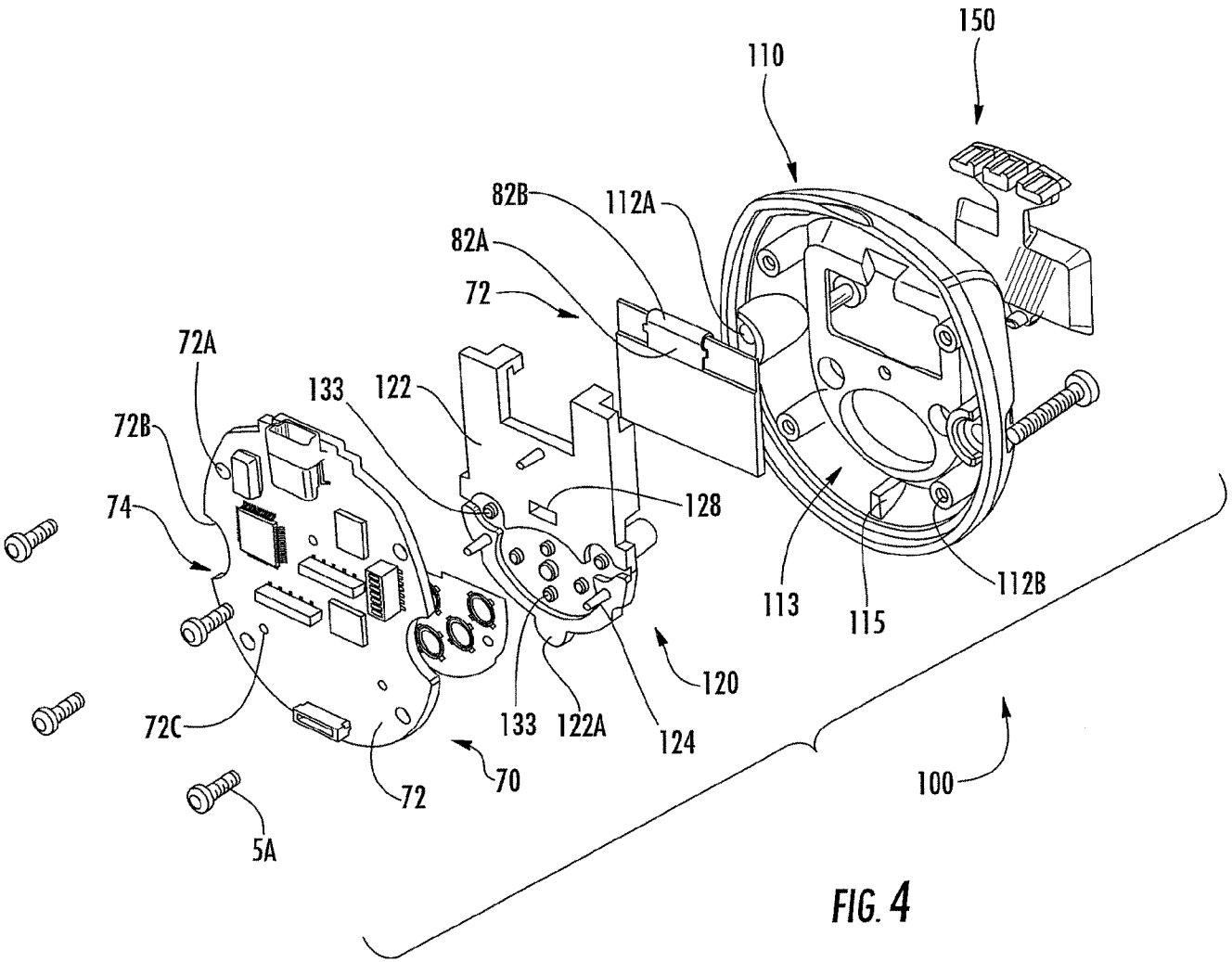
FIG. 4 is an exploded, rear perspective view of the display module of FIG. 3.
Figure 5:
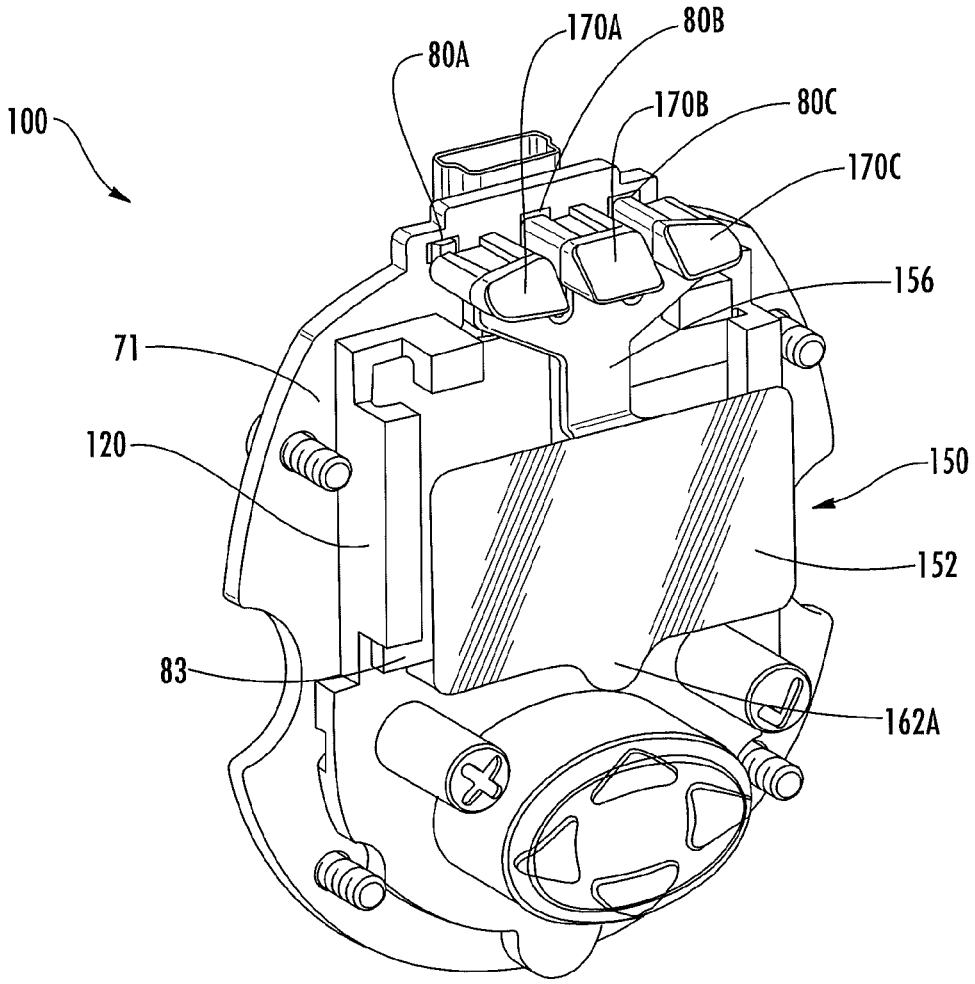
FIG. 5 is a front perspective view of the display module of FIG. 3 with a display housing of the display module removed for the purpose of explanation.

With reference to FIGS. 3 and 4, the display module 100 includes the display housing 110, the display PCB assembly 70, a keypad/subframe member 120, and the integral lens member 150. The components 110, 70, 120, 150 may be coupled to one another by fasteners 5A to form a unitary module 100. The module 100 may in turn be secured to the housing 21 with fastener holes 23 by fasteners 5B (FIG. 2).

The display housing 110 includes a body 112 defining an interior cavity 113 (FIG. 4), a display opening 114, fastener holes 112A, threaded bosses 112B (FIG. 4), indicator light openings 116A, 116B, 116C, and button holes 118A, 118B. A beveled outwardly facing edge portion 114A circumscribes the display opening 114. A cutout or side oriented slot 114B is defined in the lower periphery of the display opening 114. An upper portion 112C of the display housing 110 in the region of the indicator light openings 116A-C may be rounded as shown. A locator feature or rib 115 (FIG. 4) extends rearwardly from the body 112 into the cavity 113. Integral securing or latch features 119 (FIG. 7) are located inside the body 112 adjacent respective ones of the indicator light openings 116A-C.

With reference to FIG. 4, the display PCB assembly 70 includes a printed circuit board (PCB) 71. The PCB 71 includes a rigid or semi-rigid circuit board substrate 72 having a suitable electrical circuit 74 thereon. Fastener holes 72A, fastener cutouts or slots 72B, and alignment holes 72C are defined in the substrate 72. An electrical connector 76A (FIG. 3) is mounted on the front of the PCB 71. Flex circuits attached to suitable manufacturing structures may optionally be used (not shown).

A plurality of keypad switches 78 (FIG. 3) are mounted on the PCB 71. The keypad switches 78 may be, for example, snap dome switches. The keypad switches 78 may be operatively connected to the circuit 74.

With reference to FIG. 3, light sources 80A, 80B and 80C are mounted on the PCB 71 adjacent the upper end thereof and a light source 80D is mounted on the midsection of the PCB 71. According to some embodiments, the light sources 80A-D are light emitting diodes (LEDs). In some embodiments, two or more of the light sources 80A-D emit different colors of light from one another. The light sources 80A-D may be operably connected to the circuit 74.

The display PCB assembly 100 further includes an electronic display device 82. The display device 82 can include a ribbon cable 82B terminated by a connector 82A, and a display screen 83 (FIG. 3). The display screen 83 has a display zone or area 83A where indicia 84 can be dynamically displayed. According to some embodiments, the display area 83A is at least ten times as great as the light emission area of each of the light sources 80A-D. The display device 82 may be any electronic display device of any suitable type and construction. According to some embodiments, the display device 82 is a liquid crystal display (LCD). According to some embodiments, the display device 82 is an organic light emitting diode (OLED). According to some embodiments, the display device 82 includes a substantially rigid, breakable, light transmissive substrate (e.g., a glass panel or plate) extending across the display area 83A.

With reference to FIG. 4, the keypad/subframe member 120 is mounted on the circuit board substrate 72 and interposed between the circuit board substrate 72 and the display housing 110. The keypad/subframe member 120 includes body 122, a stabilizer feature or tab 122A, rearwardly extending alignment posts 124, retention features 126 (FIG. 3), and keypad features or buttons 132 (FIG. 3). A light pipe aperture 128 is defined in the body 122. The retention features 126 define a slot or seat 126A.

The keypad/subframe member 120 may be monolithic and the portions and features 122, 122A, 124, 126, 128 and 132 may be unitarily molded or otherwise formed such that they form a unitary structure. According to some embodiments, the keypad/subframe member 120 is formed of an elastomeric material such as silicone. Inserts 133 (FIG. 4) may be provided in the buttons 132 to provide the buttons with enhanced rigidity. In other embodiments, the features of the keypad/subframe member 120 may be distributed among two or more discrete members (e.g., a keypad member having the buttons and a subframe member having the retention features).

With reference to FIGS. 8-11, the integral lens member 150 includes a cover portion 152, a connector portion 156, a lower light pipe portion 160, and a plurality of upper light pipe portions 170A, 170B, 170C. The light pipe portions 170A-C collectively form a light pipe array 171. The sections 152, 156, 160, and 170A-C are integral with one another to form a unitary integral lens member 150. According to some embodiments, the lens member 150 (including the sections 152, 156, 160 and 170A-C) is monolithic.

According to some embodiments, the lens member 150 is unitarily formed. According to some embodiments, the lens member 150 is unitarily molded. In some embodiments, the lens member 150 is unitarily injection molded. According to some embodiments, the lens member 150 is unitarily cast.

The lens member 150 may be formed of any suitable material(s) or compositions(s). According to some embodiments, the entirety of the lens member 150 is formed of the same material or composition. The cover portion 152 and the light pipe portions 160, 170A-C are formed at least in part by a transparent or translucent material. According to some embodiments, each of the cover portion 152, the connector portion 156, the lower light pipe portion 160, and the upper light pipe portions 170A-C is transparent or translucent. According to some embodiments, the lens member 150 is formed of a polymeric material. According to some embodiments, the lens member 150 is formed of polycarbonate. The material of the lens member 150 is rigid or semi-rigid at room temperature and, according to some embodiments, has a Young's Modulus of at least about 2.0 GPa and, according to some embodiments, between about 2.0 GPa and 2.8 GPa.

Still referring to FIGS. 8-11, the cover portion 152 has a front face 154A and a rear face 154B. A rearwardly beveled perimeter edge portion 154C circumscribes the cover portion 152 and is complementary to the beveled edge portion 114A (FIG. 3).

According to some embodiments, the thickness D (FIG. 11) of the cover portion 152 is substantially uniform (except in the beveled edge portion 154C). According to some embodiments, the cover portion 152 has a thickness D in the range of from about 2 mm to about 4 mm. According to some embodiments, the height E and width F (FIG. 10) of the cover portion 152 are each in the range of from about 10 mm to about 30 mm.

The lower light pipe portion 160 includes a front section 162 contiguous and coplanar with the cover portion 152. The front section 162 has a front face 162A and a lower lip portion 162B. An elongate extension section 164 extends rearwardly from the front section 162 and terminates at a rear end face 164A. The lower light pipe portion 160 forms a light pipe or optical conduit extending from the face 164A to the face 162A.

The upper light pipe portions 170A-C are connected to the cover portion 152 by the connector portion 156, which extends from a lower end 156A to an upper end 156B merged with the cover portion 152 and the light pipe array 171, respectively. According to some embodiments, at least a midsection 156C of the connector portion 156 is narrower than both the cover portion 156 and the light pipe array. According to some embodiments and as shown, the connector portion 156 is located rearwardly of the front face 154A and the beveled edge portion 154C.

Each of the upper light pipe portions 170A-C includes a conduit section 172 terminating in an input face 174 (rearwardly facing) and an opposing output face 176 (forwardly facing). Each of the light pipe portions 170A-C includes a mounting portion 173 on its front end and a groove 178A extending from the rear end of the conduit section 172 to the mounting portion 173. The mounting portion 173 and the groove 178A define a latch feature 178B at their interface.

Figure 10:
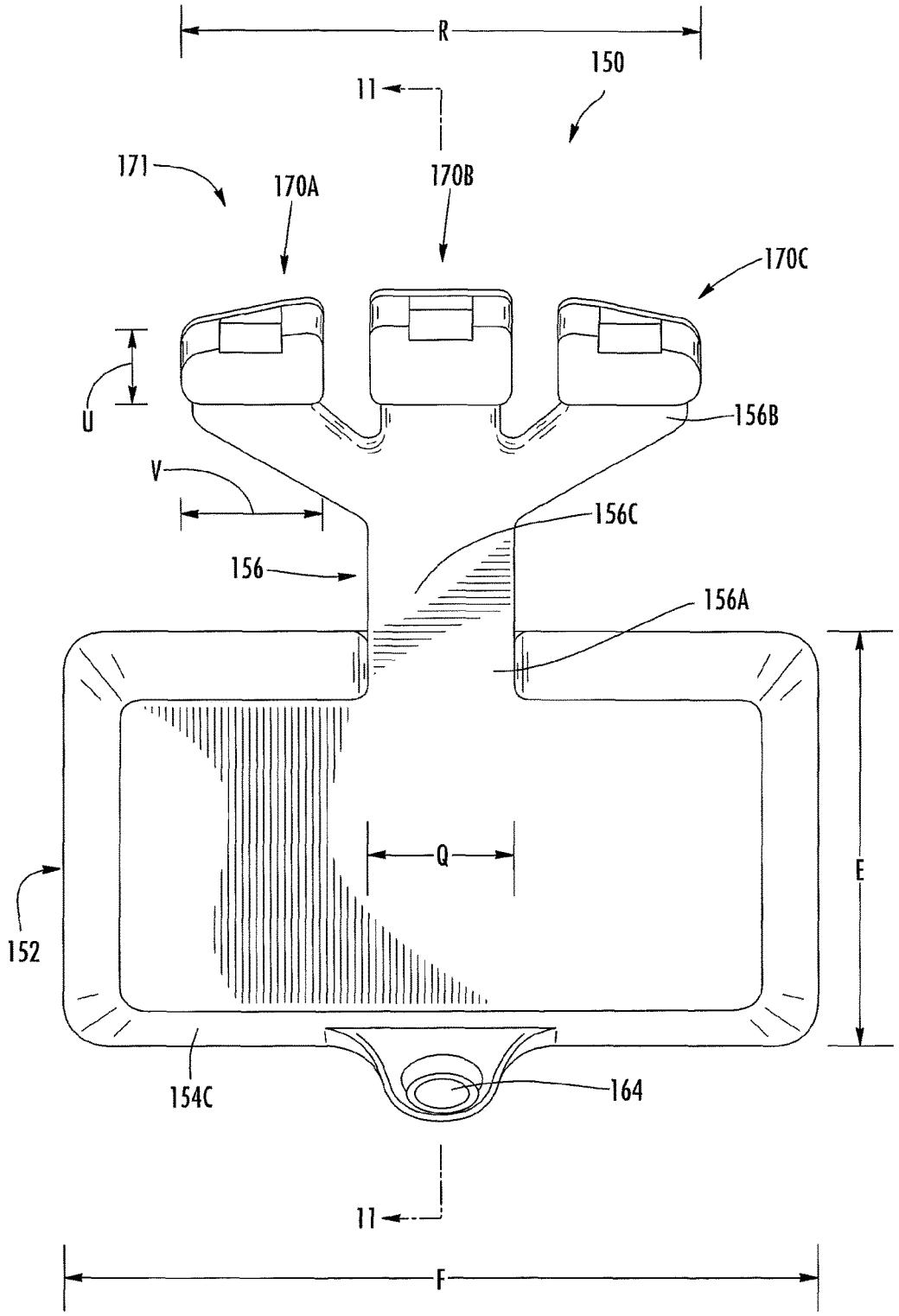
FIG. 10 is a rear plan view of the integral lens member of FIG. 8.
Figure 11:
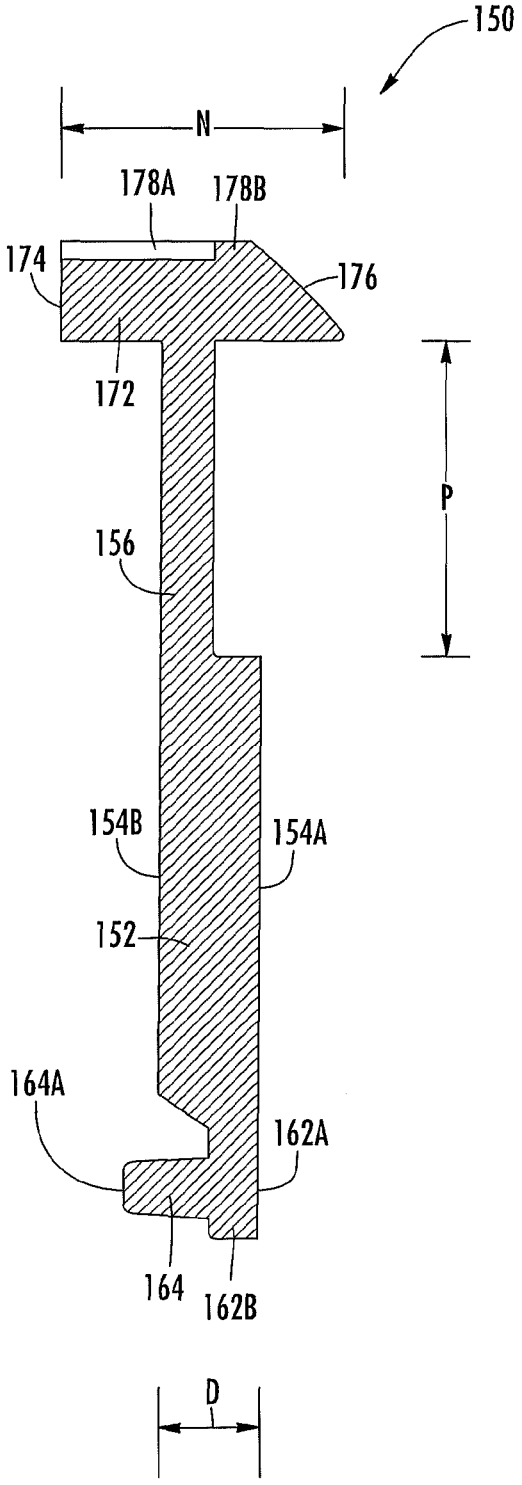
FIG. 11 is a cross-sectional view of the integral lens member of FIG. 8 taken along the line 11-11 of FIG. 10.

According to some embodiments, the length N (FIG. 11) of each light pipe portion 170A-D is in the range of from about 8 mm to about 12 mm. According to some embodiments, the nominal lateral cross-sectional area (i.e., width V×height U; FIG. 10) of each of the light pipe portions 170A-D is in the range of from about 10 $mm^2$ to about 20 $mm^2$.

According to some embodiments, the length P (FIG. 11) of the connector portion 156 is in the range of from about 8 mm to about 12 mm.

According to some embodiments and with reference to FIG. 10, the width Q of the connector portion 156 is less than both the width R of the light pipe array 171 and the width F of the cover portion 152. According to some embodiments, the widths R and F are each at least twice the width Q.

The construction of the display module 100 will be further appreciated from the following description of methods according to embodiments of the invention for assembling the display module 100. It will be understood that various of the steps described herein may be modified and/or executed in a different order.

Referring to FIGS. 3-6, the keypad/subframe member 120 is mounted on the front side of the circuit board substrate 72 such that the alignment posts 124 seat in the alignment holes 72C. The display device 82 is mounted in the seat 126A such that the display device 82 is held in place by the retention features 126. The display device connector 82A is engaged with the PCB connector 76 before or after installing the display device 82 in the seat 126A.

Figure 7:
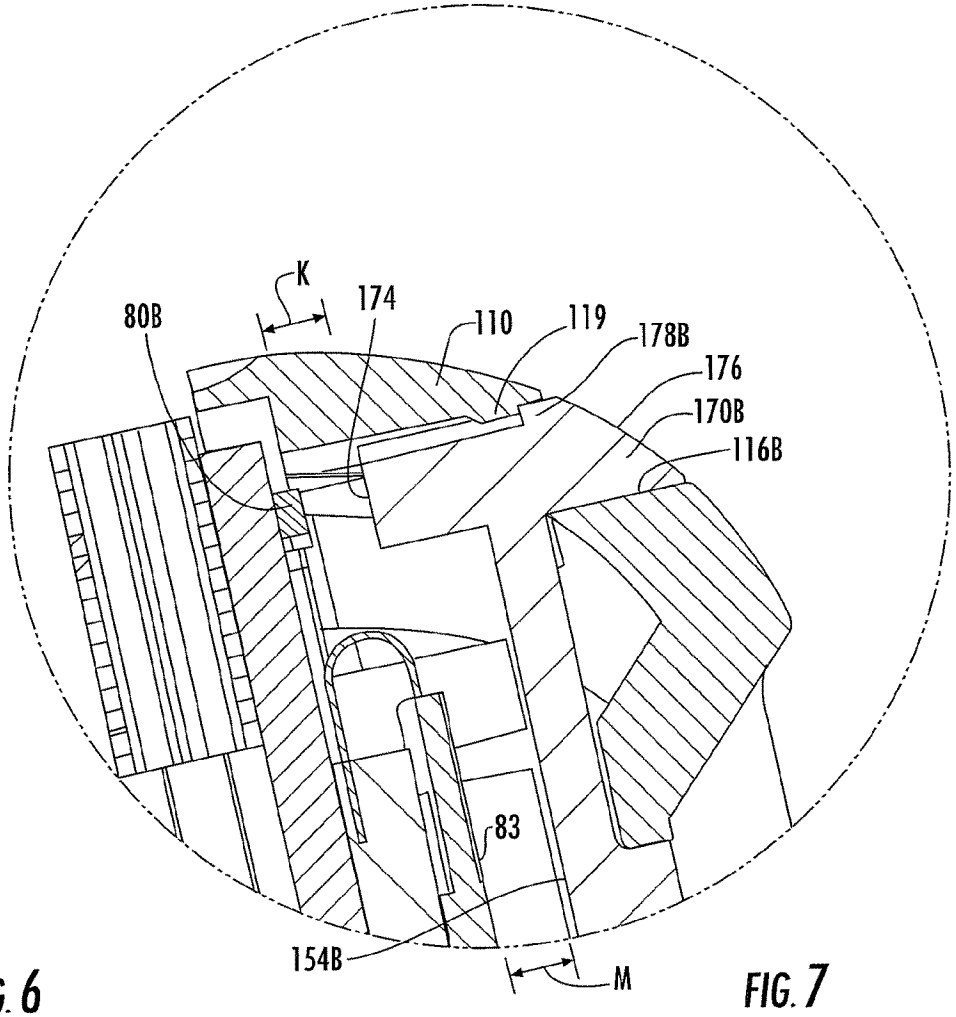
FIG. 7 is an enlarged view of the detail A of FIG. 6.
Figure 6:
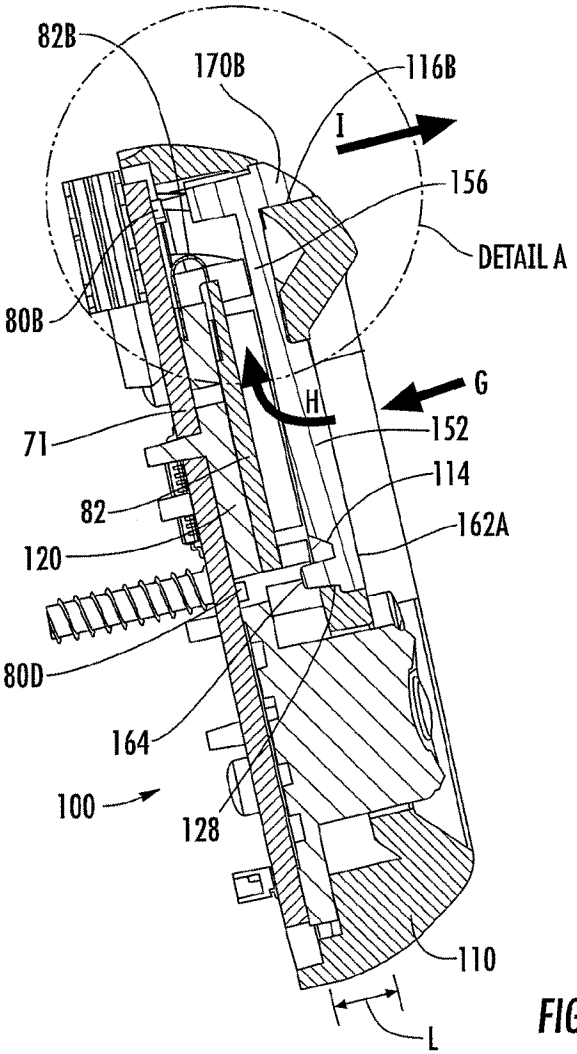
FIG. 6 is a cross-sectional view of the display module of FIG. 3 taken along the line 6-6 of FIG. 1.
Figure 8:
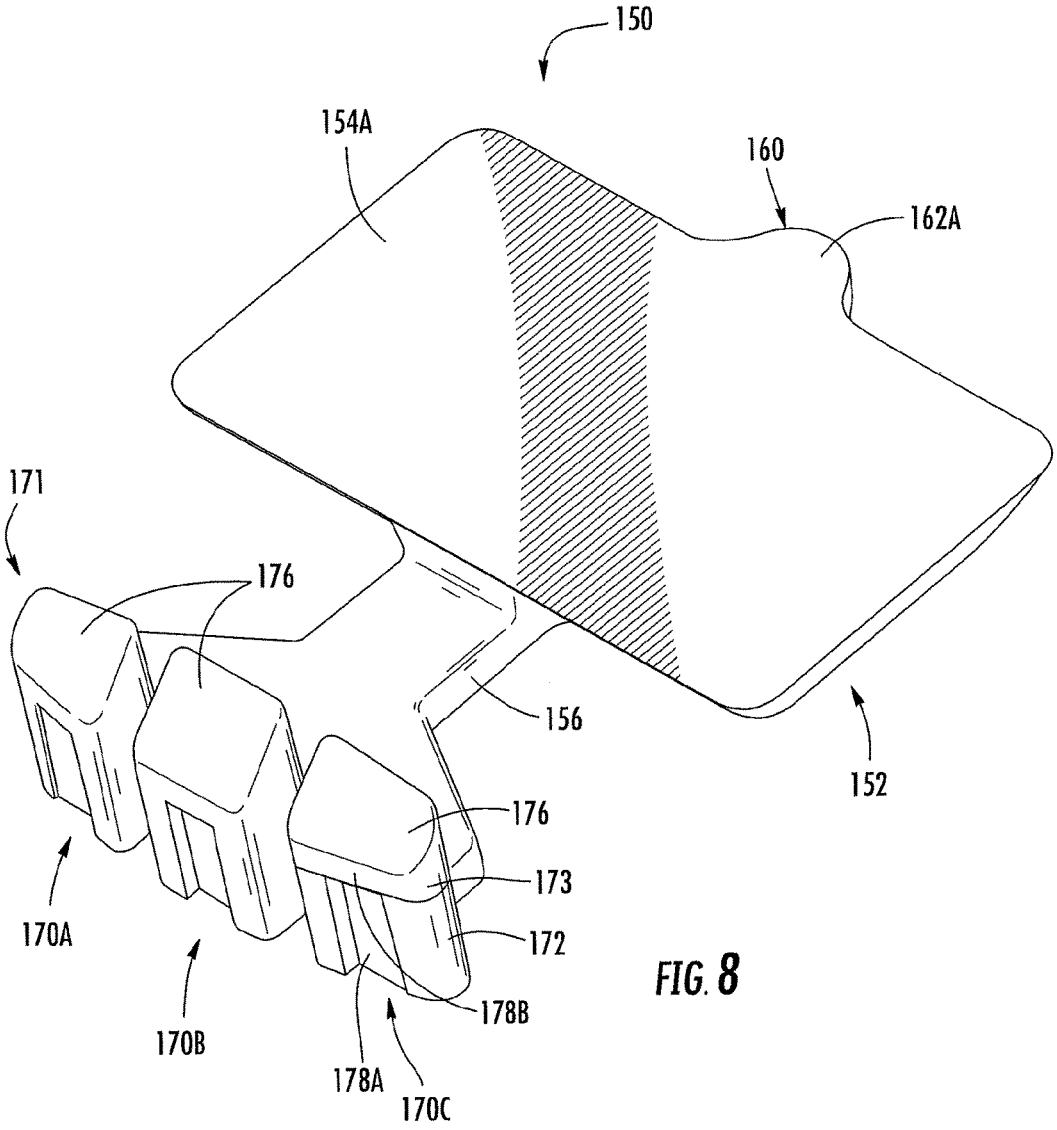
FIG. 8 is a front perspective view of an integral lens member according to embodiments of the present invention forming a part of the display module of FIG. 3.
Figure 9:
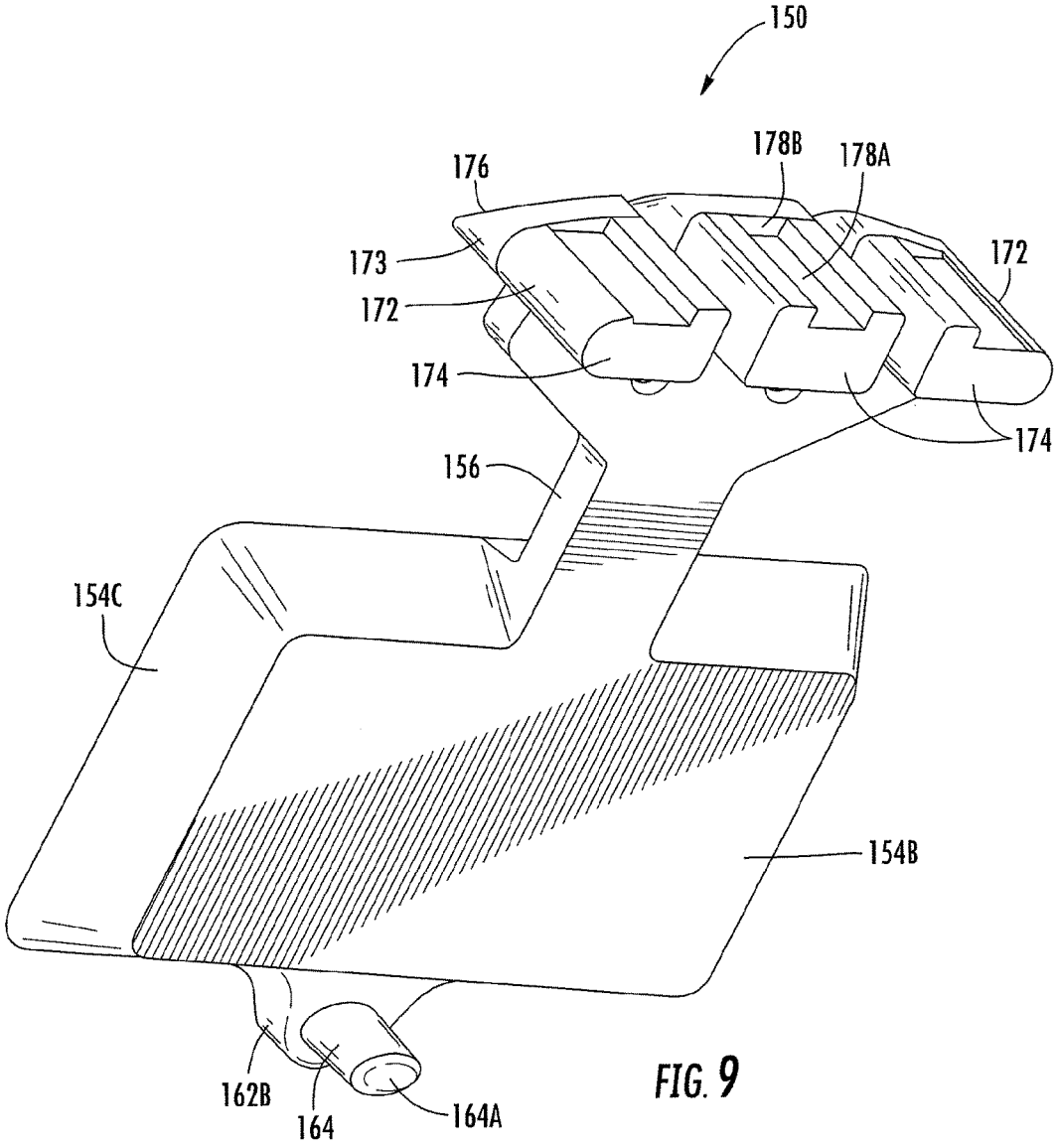
FIG. 9 is a rear perspective view of the integral lens member of FIG. 8.

With reference to FIG. 6, the integral lens member 150 is mounted in the display housing 110 by inserting the light pipe array 171 and the connector portion 156 through the display opening 114 in a direction G from front to rear, directing the light pipe array 171 upwardly (in a direction H), and then inserting or pushing the mounting portions 173 (FIG. 8) into respective ones of the indicator light openings 116A-C (in a direction I) until the latch features 119 interlock with the latch features 178B (FIG. 7). The cover portion 152 is seated in the display opening 114 such that the beveled edge portions 114A, 154C mate and the extension section 164 of the lower light pipe portion 160 extends through the opening 128 in the keypad/subframe member 120. The connector portion 156 extends behind the display housing 110. The light pipe portions 170A-C and 164 are then located adjacent their respective associated light sources 80A-D while the cover portion 152 covers or overlies the display screen 83.

According to some embodiments, the components of the display module 100 are relatively configured such that, when the lens member 150 is fully installed in the display housing 110, the connector portion 156 is slightly elastically deflected from its released (i.e., unloaded) position and therefore loads the cover portion 152 against the display housing 110 (more particularly, loads the beveled edge portion 154C against the beveled edge portion 114A). In this way, the cover portion 152 can be firmly seated.

According to some embodiments, the lens member 150 is secured to the display housing 110 by the mechanical coupling features 119, 173, 178B without use of additional supplemental securing devices such as fasteners or adhesive.

The subassembly of the combined display housing 110 and lens member 150 is placed over the combined display PCB assembly 70 and keypad/subframe member 120 and secured thereto by fasteners 5A inserted through the holes 72A and the threaded bosses 112B (FIG. 4) to form the fully assembled display module 100. The locator rib 115 (FIG. 4) may bear against the stabilizer tab 122A (FIG. 4) to limit axial displacement of the keypad/subframe member 120.

The display module 100 is in turn secured to the housing 21 by fasteners 5B inserted through the holes 112A and openings 23 (FIG. 2) in the shell members 22, 24.

In the assembled display module 100, the input faces 174, 164A (FIG. 9) of the light pipes 170A, 170B, 170C and 160 are positioned adjacent the light sources 80A, 80B, 80C and 80D, respectively. According to some embodiments and as shown in FIG. 7, the input faces 174 of the upper light pipe portions 170A-C (light pipe portion 170B shown) are spaced apart from their associated light sources 80A-C (light source 80B shown) a distance K. In some embodiments, the distance K is at least about 0.5 mm and, according to some embodiments, is in the range of from about 0.5 mm to about 3 mm. According to some embodiments, the input face 164A of the lower light pipe portion 164 is spaced apart from the light source 80D a distance L (FIG. 6) of at least about 0.5 mm and, according to some embodiments, is in the range of from about 0.5 mm to about 5 mm.

The output faces 176, 162A may be substantially flush with the outer surface of the display housing 110. More particularly, the profiles of the output faces 176 may conform to the profile of the rounded corner 112C.

The rear face 154B of the cover portion 152 is spaced apart from the front of the display screen 83 a distance M (FIG. 7). According to some embodiments, the distance M is at least about 0.5 mm and, according to some embodiments, is in the range of from about 0.5 mm to about 5 mm.

In use, the HMI 90 (FIG. 1) can be used in known or any suitable manner by the operator to input commands to the control system 60 and/or to display data from the control system 60 to the operator. In particular, data can be displayed as indicia 84 on the display screen 83 and viewable by the operator through the cover portion 152, and the indicator light sources 80A-D can be activated and deactivated (de-illuminated). The light 86 emitted from the light sources 80A, 80B and 80C (FIG. 5) is transmitted through the light pipe portions 170A, 170B and 170C, respectively, and emitted to the operator through the output faces 176, (i.e., the light from the light sources 80A-D is thereby externally visible or visible exteriorly of the housing 21). For example, the light sources 80A, 80B and 80C may be red, yellow, and green LEDs that are selectively illuminated to indicate a status of the tool such as {green LED 80A=correct torque applied}, {yellow LED 80B=undertorqued}, {red LED 80C=overtorqued}, and {blue LED 80D=tool maintenance required}.

The buttons 132 can be manipulated to input commands via the keypad switch assembly 78.

Integral lens members (e.g., the integral lens member 150), display modules (e.g., the display module 100), and methods according to embodiments of the present invention can provide a number of advantages. By combining the light pipes for the light sources 80A-D with the cover portion 152 for the display screen 83 in a single molded part, assembly of the display module 100 can be greatly simplified while also providing a compact, cost effective HMI 90 in a housing that can withstand mechanical abuse or harsh operating environments.

The mounting features 119, 173, 178B can provide a convenient and effective mechanism for mechanically coupling the lens member 150 and the display housing 110. A robust coupling can be provided without requiring additional fasteners, adhesive or the like. However, in accordance with some embodiments, fasteners or adhesive may be used in addition to the mechanical coupling features.

The gap provided between the cover portion 152 and the display screen 83 can prevent the cover portion 152 from striking the display screen 83 when deflected by an impact. The cooperating beveled edge portions 114A, 154C serve to more widely distribute such forces.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A handheld power tool comprising:

a housing;

a display device mounted on the housing;

a display housing mounted on the housing;

at least one light source mounted in the housing; and an integral, light transmissive lens member including:

a cover portion covering the display device to protect the display device from the environment; and a first and second light pipe portion each positioned and configured to transmit light emitted from a first and second light source, respectively, to a location on the handheld power tool visible exteriorly of the housing, wherein at least a portion of the display housing covers at least a portion of the lens member between the cover portion and the first light pipe portion thereby visually separating the cover portion and the first light pipe portion, wherein second light pipe portion includes a first end and an opposing second end, wherein the second light pipe portion is coupled to the cover portion at the first end, and wherein the second light pipe portion extends inwardly from the cover portion toward the second end of the second light pipe portion.

2. The handheld power tool of claim 1 wherein the lens member is a monolithic member.

3. The handheld power tool of claim 1 wherein the lens member includes a lens mounting feature to mechanically couple the lens member to the housing.

4. The handheld power tool of claim 3 wherein the housing includes a housing mounting feature that interlocks with the lens mounting feature to mechanically couple the lens member in the housing.

5. The handheld power tool of claim 1 wherein the at least one light source includes a light emitting diode (LED).

6. The handheld power tool of claim 1 wherein the display device includes at least one of an organic light emitting diode (OLED) display and a liquid crystal display (LCD) having a display screen, and the display screen is viewable through the cover portion.

7. The handheld power tool of claim 1 wherein:

the at least one light source includes a plurality of light sources mounted in the housing; and the lens member includes a plurality of light pipe portions each positioned and configured to transmit light emitted from a respective one of the plurality of light sources to a respective one of a plurality of locations on the handheld power tool visible exteriorly of the housing.

8. The handheld power tool of claim 7 wherein:

the plurality of light pipe portions collectively define a light pipe array having a first width;

the cover portion has a second width;

the lens member includes a connector portion extending between and connecting the cover portion and the light pipe array; and the connector portion has a third width that is less than each of the first and second widths.

9. The handheld power tool of claim 1 wherein:

the housing defines a display opening having a housing beveled edge portion; and the cover portion has a lens beveled edge portion complementary to and seated against the housing beveled edge portion.

10. An integral, light transmissive lens member for use in a handheld power tool, the integral lens member including:

a cover portion configured to cover the display device to protect a display of the handheld power tool device from the environment, wherein the cover portion has a first end and an opposing second end; and a first and second light pipe portion each configured to transmit light emitted from a light source of the handheld power tool to a location on the handheld power tool visible exteriorly of the handheld power tool, wherein the first light pipe portion is positioned adjacent to the first end of the cover portion and wherein the second light pipe portion is positioned adjacent to the second end of the cover portion, wherein the second light pipe portion is coupled to the cover portion at a first end of the second light pipe portion, wherein the first end of the second light pipe portion is contiguous and coplanar with at least a portion of the cover portion.

11. The lens member of claim 10 wherein the lens member is a monolithic member and includes:

a lens mounting feature to mechanically couple the lens member to a housing of the handheld power tool; and a plurality of light pipe portions each configured to transmit light from a respective one of a plurality of light sources of the handheld power tool to a respective one of a plurality of locations on the handheld power tool visible exteriorly of the handheld power tool.

12. The lens member of claim 11 in combination with a display device and a light source, wherein:

the cover portion covers the display device to protect the display device from the environment; and the light pipe portion is positioned adjacent the light source to transmit light emitted from the light source.

13. A method for forming a handheld power tool, the method comprising:

providing a housing;

mounting a display device on the housing;

mounting at least one light source in the housing;

mounting an integral, light transmissive lens member including a cover portion and a light pipe portion on the housing such that:

the cover portion covers the display device to protect the display device from the environment; and the light pipe portion is positioned to transmit light emitted from the at least one light source to a location on the handheld power tool visible exteriorly of the housing, wherein the light pipe portion is coupled to the cover portion at a first end of the light pipe portion, wherein the first end of the light pipe portion is contiguous and coplanar with at least a portion of the cover portion; and mounting a display housing on the housing, wherein.

14. The method of claim 13 including unitarily molding the lens member.

15. The method of claim 14 including unitarily injection molding the lens member.

16. The method of claim 13 wherein:

the lens member includes a lens mounting feature;

the housing includes a housing mounting feature; and mounting the integral lens member on the housing includes interlocking the housing mounting feature with the lens mounting feature to mechanically couple the lens member in the housing.

17. The method of claim 13 wherein:

the at least one light source includes a light emitting diode (LED); and the display device includes at least one of an organic light emitting diode (OLED) display and a liquid crystal display (LCD) having a display screen, and the display screen is viewable through the cover portion.

18. The method of claim 13 wherein:

the lens member includes a plurality of light pipe portions; and mounting the integral lens member on the housing includes positioning each of the plurality of light pipe portions to transmit light emitted from a respective one of the plurality of light sources to a respective one of a plurality of locations on the handheld power tool visible exteriorly of the housing.

19. The method of claim 18 wherein:

the plurality of light pipe portions collectively define a light pipe array having a first width;

the cover portion has a second width;

the lens member includes a connector portion extending between and connecting the cover portion and the light pipe array; and the connector portion has a third width that is less than each of the first and second widths.

20. The method of claim 13 wherein:

the housing defines a display opening having a housing beveled edge portion;

the cover portion has a lens beveled edge portion complementary to the housing beveled edge portion; and mounting the integral lens member on the housing includes seating the lens beveled edge portion against the housing beveled edge portion.

* * * * *